US008323751B2

(12) United States Patent
Kawamura et al.

(10) Patent No.: US 8,323,751 B2
(45) Date of Patent: Dec. 4, 2012

(54) PROCESS FOR PRODUCING ROLLER FOR ELECTROPHOTOGRAPHY

(75) Inventors: Kunimasa Kawamura, Mishima (JP); Yuji Sakurai, Susono (JP); Shohei Urushihara, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/081,044

(22) Filed: Apr. 6, 2011

(65) Prior Publication Data

US 2011/0183080 A1 Jul. 28, 2011

Related U.S. Application Data

(63) Continuation of application No. PCT/JP2010/007113, filed on Dec. 7, 2010.

(30) Foreign Application Priority Data

Dec. 21, 2009 (JP) ..... 2009-288940

(51) Int. Cl.

| | |
|---|---|
| ***H01T 19/04*** | (2006.01) |
| ***B05D 1/12*** | (2006.01) |
| ***B05D 3/00*** | (2006.01) |
| ***H05H 1/00*** | (2006.01) |

(52) U.S. Cl. ..... 427/533; 250/324; 250/325; 250/326; 427/180; 427/532; 427/535; 427/536; 427/537

(58) Field of Classification Search ..... 250/324, 250/325, 326; 427/180, 196, 488, 532, 533, 427/535, 536, 537; 492/53, 54, 56, 59
See application file for complete search history.

(56) References Cited

U.S. PATENT DOCUMENTS 4,589,053 A * 5/1986 Hosono et al. ..... 361/213
2002/0035020 A1* 3/2002 Yamaguchi et al. ..... 492/56
2008/0292366 A1* 11/2008 Akama et al. ..... 399/286
2010/0080611 A1 4/2010 Kurachi et al.

FOREIGN PATENT DOCUMENTS

JP 2002-40759 A 2/2002
JP 2008-213268 A 9/2008

OTHER PUBLICATIONS

Notification of Transmittal of International Search Report and Written Opinion of the International Searching Authority (PCT/ISA/220) dated Feb. 2, 2011, forwarding International Search Report (PCT/ISA/210) and Written Opinion of the International Searching Authority (PCT/ISA/237) in counterpart International Application No. PCT/JP2010/007113.
Machine English-language translation of JP2002-40759 A, Publication Date: Feb. 6, 2002.

(Continued)

*Primary Examiner* — Michael Cleveland
*Assistant Examiner* — Michael Wieczorek
(74) *Attorney, Agent, or Firm* — Fitzpatrick, Cella, Harper & Scinto

(57) ABSTRACT

An object of the present invention is to provide a production process of a roller for an electrophotography, having a surface layer the electric resistance of which has been controlled by corona discharge treatment while keeping any pinholes from coming about on the surface. A production process of a roller for an electrophotography, said roller comprising a conductive mandrel and a conductive surface layer comprising a resin and carbon black dispersed in the resin, the process having the following steps (1) to (3):

(1) forming a resin layer comprising a resin and carbon black dispersed therein on the circumference of the conductive mandel;

(2) attaching silica particles on the surface of the resin layer; and (3) subjecting corona discharge treatment to the surface of the resin layer on which the silica particles are attached.

6 Claims, 3 Drawing Sheets

OTHER PUBLICATIONS

Machine English-language translation of JP2008-213268 A, Publication Date: Sep. 18, 2008.

International Search Report mailed Feb. 1, 2011, in counterpart International Application No. PCT/JP2010/007113.

* cited by examiner

PROCESS FOR PRODUCING ROLLER FOR ELECTROPHOTOGRAPHY

CROSS-REFERENCE TO RELATED APPLICATIONS

This application is a continuation of International Application No. PCT/JP2010/007113, filed on Dec. 7, 2010, which claims the benefit of Japanese Patent Application No. 2009-288940, filed on Dec. 21, 2009.

BACKGROUND OF THE INVENTION

1. Field of the Invention

This invention relates to a process for producing a roller for an electrophotography, a process for producing a regenerated roller for an electrophotography, and a process for making a conductive roller low in electric resistance.

2. Description of the Related Art

In image forming apparatus that utilizes an electrophotographic system, a conductive roller having a conductive mandrel and a conductive surface layer which contains a resin and a carbon black dispersed in the resin is used as a developing roller, a charging roller, a transfer roller, a fixing roller, a cleaning roller or the like. In recent years, with progress of achieving much more high-performance of electrophotographic image forming apparatuses, it has become required to control the electric resistance of the conductive roller more precisely. In general, where a conducting agent is dispersed in a resin to make the roller conductive, its electric resistance tends to vary depending on the state of dispersion of the conducting agent.

Meanwhile, the conductive roller has a tendency of becoming high in electric resistance as a result of its continuous energization in an electrophotographic apparatus. As one of the causes thereof, such a tendency is said to be due to the fact that the state of dispersion of the conducting agent in a surface layer changes depending on the potential difference applied between the conductive mandrel and any other member coming into contact therewith. Now, from the viewpoint of lessening any environmental loads, it has become necessary to make technical development for the reuse of such conductive rollers having changed in electric resistance with their use.

Japanese Patent Application Laid-open No. 2002-40759 discloses a conductive roller for an electrophotography which has a mandrel made of a metal and provided on the periphery thereof with an elastic conductive layer is subjected to corona discharge treatment on its surface so as to make a developer adhere uniformly to the roller surface.

SUMMARY OF THE INVENTION

The present inventors have applied such corona discharge treatment as disclosed in Japanese Patent Application Laid-open No. 2002-40759, to a conductive roller on its conductive surface layer containing carbon black, where they have discovered that the roller for the electrophotography can be made to change in electric resistance by keeping a corona discharge electrode close to the roller or applying a higher electric power to the corona discharge electrode. It, however, has been found that, where the corona discharge treatment that can make the electric resistance change is applied, such discharge causes a phenomenon of short-circuit leakage to bring about a problem that pinholes are formed on the surface of the surface layer and that the surface comes roughened.

Accordingly, the present invention is directed to provide a process for producing a roller for an electrophotography, having a surface layer the electric resistance of which has been controlled by corona discharge treatment carried out while keeping its surface properties from being affected. Another object of the present invention is to provide a process for producing a high-grade regenerated roller for an electrophotography, having been regenerated by making a conductive surface layer low in electric resistance which has become high in electric resistance with its use.

The present invention is also directed to provide a process for treating a roller for an electrophotography which has a conductive surface layer containing carbon black, to make the surface layer low in electric resistance.

According to one aspect of the present invention, there is provided a production process of a roller for an electrophotography, said roller comprising a conductive mandrel and a conductive surface layer comprising a resin and carbon black dispersed in the resin, said process comprising the steps of: (1) forming a resin layer comprising a resin and carbon black dispersed therein on the circumference of the conductive mandrel; (2) attaching silica particles on the surface of the resin layer; and (3) subjecting corona discharge treatment to the surface of the resin layer on which the silica particles are attached.

According to another aspect of the present invention, there is provided a manufacturing process of a regenerated roller for an electrophotography, comprising the steps of: attaching silica particles on the surface of a roller for an electrophotography, said roller provided with a conductive mandrel and a surface layer comprising a resin and carbon black dispersed therein; and subjecting a corona discharge treatment to the surface of the roller on which the silica particles are attached. According to a further aspect of the present invention, there is provided a process for decreasing an electric resistance of a conductive roller comprising the steps of: attaching silica particles on the surface of a conductive roller, said roller provided with a conductive mandrel and a surface layer containing a resin and carbon black dispersed therein; and subjecting the surface of the conductive roller on which the silica particles are attached to a corona discharge treatment.

According to the present invention, the electric resistance of the surface layer can be controlled while keeping any pinholes from coming about on the surface of the roller for the electrophotography. As the result, a roller for an electrophotography can be obtained which contributes to formation of high-grade electrophotographic images. According to the present invention, a regenerated roller for an electrophotography can also be obtained which is again usable in forming high-grade electrophotographic images as having been regenerated by making the surface layer of a roller for an electrophotography low in electric resistance which has a surface layer having become high in electric resistance as a result of use. Further, according to the present invention, the roller for the electrophotography that has a conductive surface layer containing carbon black can be treated to make the surface layer low in electric resistance.

Further features of the present invention will become apparent from the following description of exemplary embodiments with reference to the attached drawings.

DESCRIPTION OF THE EMBODIMENTS

Figure 1A:
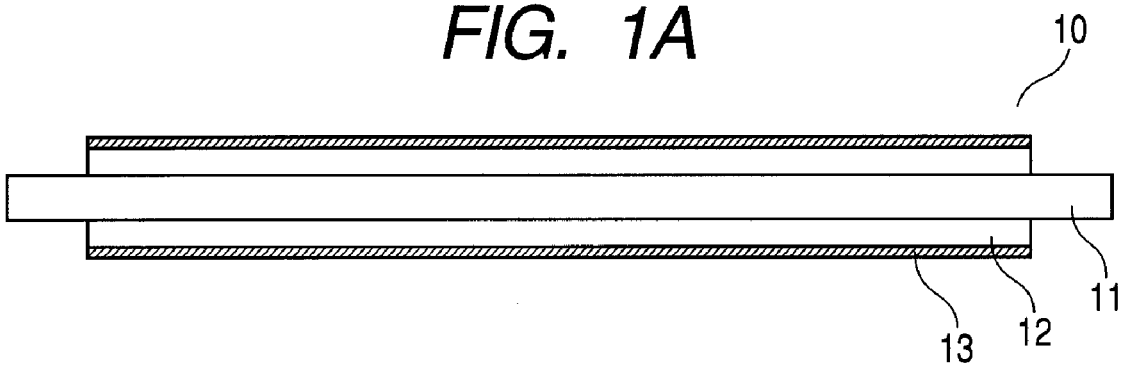
FIG. 1A is a schematic sectional view parallel to the lengthwise direction, showing an example of the roller for the electrophotography of the present invention.

Preferred embodiments of the present invention will now be described in detail in accordance with the accompanying drawings.

The present inventors have discovered that, as mentioned above, the surface of a resin layer with carbon black dispersed therein may be subjected to corona discharge treatment after silica particles have been attached to that surface, whereby a surface layer having been made low in electric resistance can be obtained without destroying the surface of the conductive roller. Thus, they have accomplished the present invention. The present inventors presume the reasons therefor as stated below.

The carbon black in the resin layer is not the case that it stands perfectly uniformly dispersed in the resin layer. It is densely present at some part and sparsely present at some part. Hence, where the surface of such a resin layer with carbon black dispersed therein is directly subjected to corona discharge treatment, the corona electric current comes concentrated on the part where the carbon black is densely present. As the result, any excess corona electric current continues to flow through the part where the carbon black is densely present, to tend to cause the phenomenon of short-circuit leakage to make pinholes or the like form on the surface in some cases. The use of such a roller for an electrophotography as a developing roller and a charging roller in forming electrophotographic images may cause defects such as black spots and white spots in the electrophotographic images.

Accordingly, the present inventors have made extensive studies on how to keep the short-circuit leakage from occurring that may occur when the electric resistance of the surface layer is controlled by subjecting the surface of the conductive roller to corona discharge treatment. As the result, they have discovered that the surface of the resin layer with carbon black dispersed therein may be subjected to corona discharge treatment after silica particles have been attached to that surface and this is effective in keeping the phenomenon of short-circuit leakage from occurring.

The silica particles standing attached to the surface of the conductive roller prevent any excess corona electric current from continuing to flow through any specific sites of the surface layer, to keep the short-circuit leakage from occurring during the corona discharge treatment, and this keeps the roller surface from coming to be damaged with occurrence of such short-circuit leakage, as so considered. More specifically, where such a conductive roller to the surface of which the silica particles stand attached is subjected to corona discharge treatment on that surface, the silica particles are negatively charged during the corona discharge. Hence, the electric field of the corona discharge may so act as to make the silica particles present in a higher density at the part where the corona electric current stands concentrated. As the result, the part where the corona electric current stands concentrated on the conductive roller surface comes to have relatively low electrical conductivity, so that the short-circuit leakage is kept from occurring, as so considered.

The process for decreasing the electric resistance of the conductive roller according to the present invention has the step of attaching silica particles to the surface of the conductive roller comprising a conductive mandrel and a surface layer containing a resin and a carbon black dispersed in the resin, and the step of subjecting to corona discharge treatment the surface layer to which the silica particles stand attached, to make the surface layer low in electric resistance.

The silica particles may be attached to the conductive roller surface preferably in an amount of from 0.005 mg/cm$^2$ to 0.100 mg/cm$^2$. Inasmuch as the silica particles are attached in an amount of not less than 0.005 mg/cm$^2$, the phenomenon of short-circuit leakage can more surely be kept from occurring. Also, inasmuch as the silica particles are attached in an amount of not more than 0.100 mg/cm$^2$, the effect of making low in electric resistance can more effectively be obtained.

Further, it is preferable for the corona discharge treatment to be carried out in the state a positive bias is applied to the conductive mandrel. By applying a positive bias to the conductive mandrel, the silica particles having been negatively charged during the corona discharge can be retained in a high density on the roller surface, and the phenomenon of short-circuit leakage can more surely be kept from occurring, to make any image defects not easily come.

The process for decreasing the electric resistance of the conductive roller according to the present invention may also be applied to a process for producing a regenerated roller for an electrophotography by which a roller for an electrophotography which has a conductive mandrel and a conductive surface layer containing a resin and a carbon black dispersed in the resin and has become high in electric resistance as a result of its use can be regenerated to produce a regenerated roller for an electrophotography. Stated specifically, such a process comprises the following steps so as to produce a regenerated roller for an electrophotography which has been made low in electric resistance.

The step of attaching silica particles on the surface layer of the roller for the electrophotography which has become high in electric resistance.

The step of subjecting corona discharge treatment to the surface layer on which the silica particles are attached.

The present invention also embraces the roller for the electrophotography that has been produced by this process of a regenerated roller for an electrophotography.

The roller for the electrophotography that has been used out may undergo, before the silica particles are attached thereto, the step of removing any deposits of developer origin which stand adherent to the surface of the roller for the electrophotography after its use. As a method for their removal, there are no particular limitations thereon. For example, the surface may be put to air blowing, and further any residues may be made to adhere to a pressure-sensitive adhesive tape and be removed. As a degree of removal, the removal may be made until the pressure-sensitive adhesive tape comes no longer colored with the deposits.

Embodiments of the present invention are described below in detail with reference to the accompanying drawings, by which, however, the present invention is by no means limited.

<Roller for Electrophotography According to Invention>

Figure 1B:
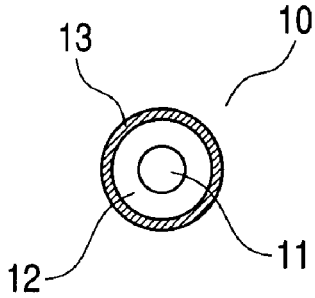
FIG. 1B is a schematic sectional view perpendicular to the lengthwise direction, showing an example of the roller for the electrophotography of the present invention.

An example of the roller for the electrophotography according to the present invention is shown in FIGS. 1A and 1B diagrammatic views. An elastic layer may be, or need not be, formed between the conductive mandrel and the surface layer. The surface layer may also be formed in two or more layers.

FIG. 1A presents a section that is parallel to the lengthwise direction of the roller for the electrophotography, and FIG. 1B presents a section that is perpendicular to the lengthwise direction of the same. In what is shown in FIGS. 1A and 1B, a roller 10 for an electrophotography has a cylindrical conductive mandrel 11 and, provided on the periphery thereof, an elastic layer 12 and further provided on the periphery thereof a surface layer 13.

The roller for the electrophotography shown in FIGS. 1A and 1B is described below in detail.

(Conductive Mandrel)

Materials for the conductive mandrel 11 are not particularly limited as long as they are electrically conductive, and may be used under appropriate selection from among carbon steel, alloy steel, cast iron and conductive resins. The alloy steel may include stainless steel, nickel chromium steel, nickel chromium molybdenum steel, chromium steel, chromium molybdenum steel, and nitriding steel to which Al, Cr, Mo and V have been added.

(Elastic Layer)

The elastic layer is provided in order to provide the roller with the elasticity that is required in apparatus to be used. As its specific constitution, it may be a solid or a foam. The elastic layer may also be a single layer or may consist of a plurality of layers. For example, in the case of the developing roller or charging roller, it is always kept into pressure contact with a photosensitive drum and a toner, and hence, in order for these members to be less mutually damaged between them, an elastic layer is provided which has the properties of low hardness and low compression set.

As a material for the elastic layer, it may include natural rubber, isoprene rubber, styrene rubber, butyl rubber, butadiene rubber, fluororubber, urethane rubber and silicone rubber. Any of these may be used alone or in combination of two or more types.

The elastic layer 12 may preferably be in a thickness of from 0.5 mm to 10.0 mm in order to provide the roller 10 for the electrophotography with a sufficient elasticity. Inasmuch as the elastic layer 12 is formed in a thickness of not less than 0.5 mm, the roller 10 for the electrophotography can have a sufficient elasticity and the photosensitive drum can be kept from wearing. Also, inasmuch as the elastic layer 12 is formed in a thickness of not more than 10.0 mm, the roller 10 for the electrophotography can promise the reduction of cost.

The elastic layer 12 may preferably have an Asker-C hardness of from 10 degrees to 80 degrees. Inasmuch as the elastic layer 12 has an Asker-C hardness of not less than 10 degrees, any image defects caused by the deformation of the elastic layer can be kept from occurring. Also, inasmuch as the elastic layer 12 has an Asker-C hardness of not more than 80 degrees, the photosensitive drum can be kept from wearing.

To the elastic layer 12, a filler may be added as long as it does not damage the properties of low hardness and low compression set.

The roller 10 for the electrophotography must have electric resistance value of a semiconductor region. Accordingly, it is preferable that the elastic layer 12 contains a conducting agent and is formed of a rubber material having a volume resistivity of from $1\times10^4$ Ω·cm to $1\times10^{10}$ Ω·cm. Here, as long as the elastic layer material has the volume resistivity of from $1\times10^4$ Ω·cm to $1\times10^{10}$ Ω·cm, it can achieve a uniform charge controllability for toners. Further, it is much preferable for that material to have a volume resistivity of from $1\times10^4$ Ω·cm to $1\times10^9$ Ω·cm.

The volume resistivity of the elastic layer material may be measured by the following method.

First, the material of the elastic layer 12 is cured under the same conditions as those in forming the elastic layer 12 and in the same thickness as the elastic layer 12 to prepare a flat-plate-shaped test piece. Next, from this test piece, a test piece of 30 mm in diameter is cut out. The test piece thus cut out is provided on one side thereof with a vacuum-deposited film electrode (back side electrode) by Pt—Pd vacuum deposition over its whole surface, and is provided on the other side thereof with a main-electrode film of 15 mm in diameter and a guard-ring electrode film of 18 mm in inner diameter and 28 mm in outer diameter in a concentric form by likewise forming Pt—Pd vacuum-deposited films. Here, the Pt—Pd vacuum-deposited films are obtained by operating vacuum deposition for 2 minutes at a current value of 15 mA, using MILDSPUTTER E1030 (manufactured by Hitachi Ltd.). The test piece on which the operation of vacuum deposition has been completed is used as a measuring sample.

Next, an instrument set up as shown in Table 1 below is used to measure the volume resistance of the measuring sample under conditions also shown in Table 1 below. In measuring it, a main electrode is so placed as not to protrude from the main-electrode film of the measuring sample. A guard-ring electrode is also so placed as not to protrude from the guard-ring electrode film of the measuring sample. It is measured in an environment of temperature 23° C. and humidity 50% RH, where, before the measurement, the measuring sample is left to stand in that environment for 12 hours or more.

TABLE 1

| | |
|---|---|
| Sample box | Sample Box for ultra-high resistance measurement (trade name: TR42; manufactured by Advantest Co., Ltd.) |
| Main electrode | Metal of 10 mm in bore diameter and 10 mm in thickness |
| Guard-ring electrode | Metal of 20 mm in inner diameter, 26 mm in outer diameter and 10 mm in thickness |
| Resistance meter | Ultra-high resistance meter (trade name: R8340A; manufactured by Advantest Co., Ltd.) |
| Measuring mode | Program mode 5 (charging and measuring for 30 seconds, and discharging for 10 seconds |
| Applied voltage | 100 V |

Where the volume resistance value thus measured is represented by RM (Ω), and the thickness of the test piece is represented by t (cm), the volume resistivity RR (Ω·cm) of the elastic layer material may be determined according to the following expression.

$$RR(\Omega\cdot\text{cm})=n\times0.75\times0.75\times RM(\Omega)/t(\text{cm})$$

As a means for making the material of the elastic layer 12 electrically conductive, a method is available in which a conductivity-providing agent that acts by the mechanism of ion conduction or the mechanism of electron conduction is added to the material to make it electrically conductive. The conductivity-providing agent that acts by the mechanism of ion conduction may include as specific examples thereof the following: salts of Group 1 metals of the periodic table, such as $LiCF_3SO_3$, $NaClO_4$, $LiClO_4$, $LiAsF_6$, $LiBF_4$, NaSCN, KSCN and NaCl; ammonium salts such as $NH_4Cl$, $(NH_4)_2SO_4$ and $NH_4NO_3$; and salts of Group 2 metals of the periodic table, such as $Ca(ClO_4)_2$ and $Ba(ClO_4)_2$. The conductivity-providing agent that acts by the mechanism of electron conduction may also include as specific examples thereof the following: carbon type materials such as carbon black and graphite; metals or alloys, such as aluminum, silver, gold, a tin-lead alloy and a copper-nickel alloy; and metal oxides such as zinc oxide, titanium oxide, aluminum oxide, tin oxide, antimony oxide, indium oxide and silver oxide. Any of these conductivity-providing agents that act by the mechanism of ion conduction or the mechanism of electron conduction may be used alone or in combination of two or more types, in the form of powder and fiber. Of these, carbon black is preferred from the viewpoint of promising easy control of conductivity and being economical.

(Surface Layer)

As a material used for the surface layer 13, it may include the following. Phenol resins, urethane resins, silicone resins, acrylic urethane resins, epoxy resins, diallyl phthalate resins, polycarbonate resins, fluorine resins, polypropylene resins and urea resins. Any of these may also be used in combination of two or more types. In the developing roller and charging roller, in order to control the charging of toners, it is especially preferable to use a urethane resin and acrylic urethane resin that is a nitrogen-containing compound. In particular, it is much preferable for the material to be composed of a urethane resin obtained by allowing an isocyanate compound to react with a polyol. The isocyanate compound may include as specific examples thereof the following. Diphenylmethane-4,4'-diisocyanate, 1,5-naphthalene diisocyanate, 3,3'-dimethylbiphenyl-4,4'-diisocyanate, and 4,4'-dicyclohexylmethane diisocyanate. A mixture of any of these may also be used, where their mixing proportion may be of any proportion.

The polyol used here may include the following: As dihydric polyols (diols), ethylene glycol, diethylene glycol, propylene glycol, dipropylene glycol, 1,4-butanediol, and hexanediol; as trihydric or higher polyols, 1,1,1-trimethylolpropane, glycerin, pentaerythritol, and sorbitol. Further usable are polyols such as high molecular weight polyethylene glycols obtained by the addition of ethylene oxide or propylene oxide to diols or triols, polypropylene glycol, and ethylene oxide-propylene oxide block glycol. A mixture of any of these may also be used.

Further, such a surface layer 13 may be used in the state it is provided with electrical conductivity. In the present invention, as a means for making the surface layer 13 material electrically conductive, the carbon black that is the conductivity-providing agent that acts by the mechanism of electron conduction is added to the above material when used. This is because the use of the carbon black, which is well dispersible in the surface layer material, makes it easy to obtain the effect of making low in electric resistance by the corona discharge treatment, and facilitates the controlling of electrical conductivity.

The surface layer 13 may preferably have a thickness of from 1.0 μm to 500.0 μm. Further, it may much preferably have a thickness of from 1.0 μm to 50.0 μm. Inasmuch as the surface layer 13 is in a thickness of not less than 1.0 μm, it can be provided with durability. Also, inasmuch as it is in a thickness of not more than 500.0 μm, and further preferably not more than 50.0 μm, it can have a low MD-1 hardness and can keep the photosensitive drum from wearing. The thickness of the surface layer 13 in the present invention refers to the arithmetic mean of the distances at arbitrary five spots that extend from the interface between the surface layer and the elastic layer to the plane of the surface of the surface layer where any cross section in the thickness direction of the surface layer is observed on a digital microscope VHX-600, manufactured by Keyence Corporation.

The roller 10 for the electrophotography may preferably have an MD-1 hardness of from 25.0° to 40.0°. Inasmuch as it has an MD-1 hardness of not less than 25.0°, it can be kept from being deformed by its contacting members. Inasmuch as it also has an MD-1 hardness of not more than 40.0°, it can keep the photosensitive drum from wearing. Here, the MD-1 hardness refers to the value of micro rubber hardness measured with a micro rubber hardness meter (trade name: MD-1 capa Type A, making use of a peak-hold mode; manufactured by Kobunshi Keiki Co., Ltd.), in a room controlled to a temperature of 23° C. and a humidity of 50% RH.

The roller 10 for the electrophotography may preferably have a surface roughness of approximately from 0.01 μm to 5.00 μm in center-line average roughness Ra according to the standard of surface roughness prescribed in JIS B 0601:1994.

As a means for controlling the surface roughness, it is effective to incorporate the surface layer 13 with particles having a desired particle diameter. Additionally, before or after the surface layer is or has been formed, an appropriate polishing treatment may be carried out so that the surface layer may be formed in the desired surface roughness. In such a case, where the elastic layer is formed in a plurality of layers, the polishing treatment may be carried out after such a plurality of layers has been formed. Also, where the elastic layer and the surface layer are formed, the elastic layer may be subjected to polishing treatment after its formation and then the surface layer is formed, or the surface layer may be subjected to polishing treatment after its formation.

As the particles to be incorporated in the surface layer 13, metal particles and resin particles may be used which are 0.1 μm to 30.0 μm in particle diameter. In particular, resin particles are preferred as having a rich flexibility, having a relatively small specific gravity and easily achievable of stability of coating materials. Such resin particles may include urethane particles, nylon particles, acrylic particles and silicone particles. Any of these particles may be used alone or in the form of a mixture of a plurality of types. Where the surface layer is formed in a plurality of layers, the particles may be incorporated in all layers of the plurality of layers, or the particles may be incorporated in at least one layer of the plurality of layers.

<Silica Particles>

The silica particles to be attached to the surface of the roller for the electrophotography or that of the conductive roller according to the present invention are described below. The silica particles may have an average primary particle diameter of approximately from 70 nm or more to 300 nm or less. Here, the average primary particle diameter is the sphere-equivalent reduced particle diameter that is determined by the measured value of BET specific surface area. Then, the BET specific surface area may be determined by the BET one-point method, from the level of adsorption of nitrogen gas. In Examples given later, MULTISOP (trade name), manufactured by Yuasa Ionics Co., is used in measuring the BET specific surface area. Also, it is measured under conditions of a deaeration temperature of 150° C. and a deaeration time of 20 minutes. Inasmuch as the silica particles have average primary particle diameter within the above range, the silica particles can be kept from agglomerating in excess on the resin layer surface and can more uniformly be attached to the resin layer surface.

As methods for producing the silica particles used in the present invention, any desired processes may be used, such as a dry process and a wet process. The dry process is a process in which silicon tetrachloride is burned at a high temperature together with a mixed gas of oxygen, hydrogen and dilute gas (e.g., nitrogen, argon and carbon dioxide) to produce silica particles. In order to produce silica particles having a large particle diameter, it is preferable to use a sol-gel process in which an alkoxysilane is subjected to hydrolysis and condensation reaction in the presence of a catalyst in a water-containing organic solvent and thereafter, from the silica sol suspension obtained, the solvent is removed to form a gel, followed by drying to obtain silica particles. A fine powder may also be used which is so made up that inorganic fine particles other than silica particles as cores which are coated with silica on their surfaces.

The silica particles according to the present invention may be particles the surfaces of which have chemically been treated. In particular, it is preferable to use those having been subjected to hydrophobic treatment for the purpose of making the particles hydrophobic and controlling their chargeability. A hydrophobic-treating agent therefor may include the following. Silicone varnish, various modified silicone varnishes, silicone oil, various modified silicone oils, silane coupling agents, silane coupling agents having functional groups, and besides organosilicon compound. Any of these may be used in combination.

<Silica Particles Attaching Apparatus According to Invention>

Figure 2:
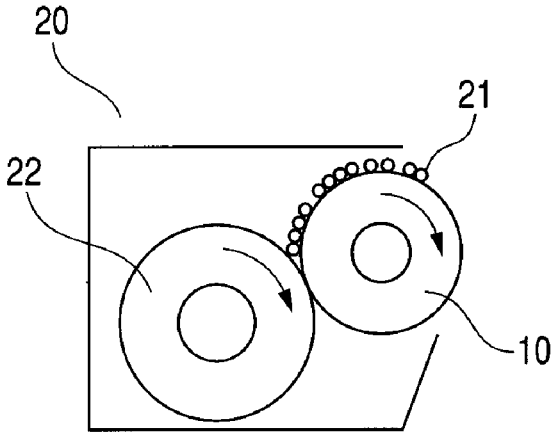
FIG. 2 is a schematic structural view showing an example of a silica particles attaching apparatus according to the present invention.

FIG. 2 is a schematic structural view showing an example of an apparatus for attaching to the surface of the resin layer the silica particles used in the present invention (hereinafter also "silica particles attaching apparatus"). In what is shown in FIG. 2, a silica particles attaching apparatus 20 is constituted of a roller for an electrophotography, silica particles 21 and a silica particles feed roller 22.

The roller 10 for the electrophotography is rotatably disposed in contact with the silica particles feed roller 22, which is also rotatable. To mandrels of the silica particles feed roller 22 and roller 10 for the electrophotography, motors (not shown) are so connected as to make the formers rotatably drivable.

The silica particles feed roller 22 used may preferably have a foamed elastic layer which is so formed around the mandrel that foam cells stand open to the peripheral surface of the roller.

A base material for the foamed elastic layer may include the following. Rubber raw materials such as polyurethane resin, nitrile rubber, ethylene-propylene rubber, ethylene-propylene-diene rubber, styrene-butadiene rubber, butadiene rubber, isoprene rubber, natural rubber, silicone rubber, acrylic rubber, chloroprene rubber, butyl rubber and epichlorohydrin rubber, or monomers which are raw materials for producing these rubber raw materials. Any of these may also be used in combination of two or more types. Of these, in view of durability, it is particularly preferable to use polyurethane resin. In particular, it is much preferable to use a polyurethane resin obtained by allowing an isocyanate compound to react with a polyol. In the foamed elastic layer of the silica particles feed roller 22, the cells standing open to the surface are so formed as to have an opening diameter of from 0.01 mm or more to 1 mm or less and be in the range of from 30% or more to 90% or less in area ratio to the surface area of the foamed elastic layer. This is preferable because the silica particles can stably be fed to the roller 10 for the electrophotography.

How the silica particles attaching apparatus operates is described next.

First, the silica particles feed roller 22 is placed in the state it is made to hold the silica particles 21 sufficiently thereon. The silica particles held thereon may preferably be in an amount sufficiently larger than the amount of the silica particles to be attached to the roller 10 for the electrophotography. Approximately, the former may be in an amount of from not less than 5 times to not more than 1,000 times the amount (mass) of the latter attached to the roller 10 for the electrophotography. Next, the roller 10 for the electrophotography to which the silica particles 21 are to be attached is so placed against the silica particles feed roller 22 that the former is in a desired level of penetration into the latter. The former's level of penetration into the silica particles feed roller 22 may be approximately from 0.5 mm or more to 5 mm or less.

Thereafter, the silica particles feed roller 22 and the roller 10 for the electrophotography are rotatingly driven by the motor at a desired rotational speed to start to attach the silica particles 21 to the surface of the surface layer of the roller 10 for the electrophotography. Their rotational speed and rotational direction may be selected as desired. As their rotating drive, both the silica particles feed roller 22 and the roller 10 for the electrophotography may rotatingly be driven, or the motor may be connected to either one so that the other may be follow-up rotated. Upon lapse of a desired treatment time, their rotating drive is stopped and then the roller 10 for the electrophotography is detached to complete the treatment. The amount of the silica particles to be attached may be controlled by appropriately adjusting the level of penetration of the roller 10 for the electrophotography into the silica particles feed roller 22, the rotational speeds of the silica particles feed roller and roller 10 for the electrophotography, and the treatment time.

<Measurement of Amount of Silica Particles Attached According to Invention>

The amount of the silica particles attached may be measured in the following way. A pressure-sensitive adhesive tape (trade name: SCOTCH MENDING TAPE; available from Sumitomo 3M Limited) having a desired area (e.g., 1 cm×1 cm) is stuck to the roller surface to which the silica particles have been attached, to take off the silica particles to the tape. A gain in weight of the pressure-sensitive adhesive tape in measurement made before and after the silica particles adhere or have adhered to the tape is measured and the area of roller surface over which the silica particles have actually been taken off to the tape is also measured, to calculate the amount per unit area of the silica particles attached. Where some silica particles have remained on the surface of the roller for the electrophotography, a virgin pressure-sensitive adhesive tape may be readied to take off any silica particles repeatedly to the tape, and a gain in weight of the pressure-sensitive adhesive tape may be added to calculate the total. Here, the amount of the silica particles attached according to the present invention is taken as the arithmetic mean of amounts at arbitrary ten spots on the surface of the roller for the electrophotography.

<Corona Discharge Treatment Apparatus>

Figure 3:
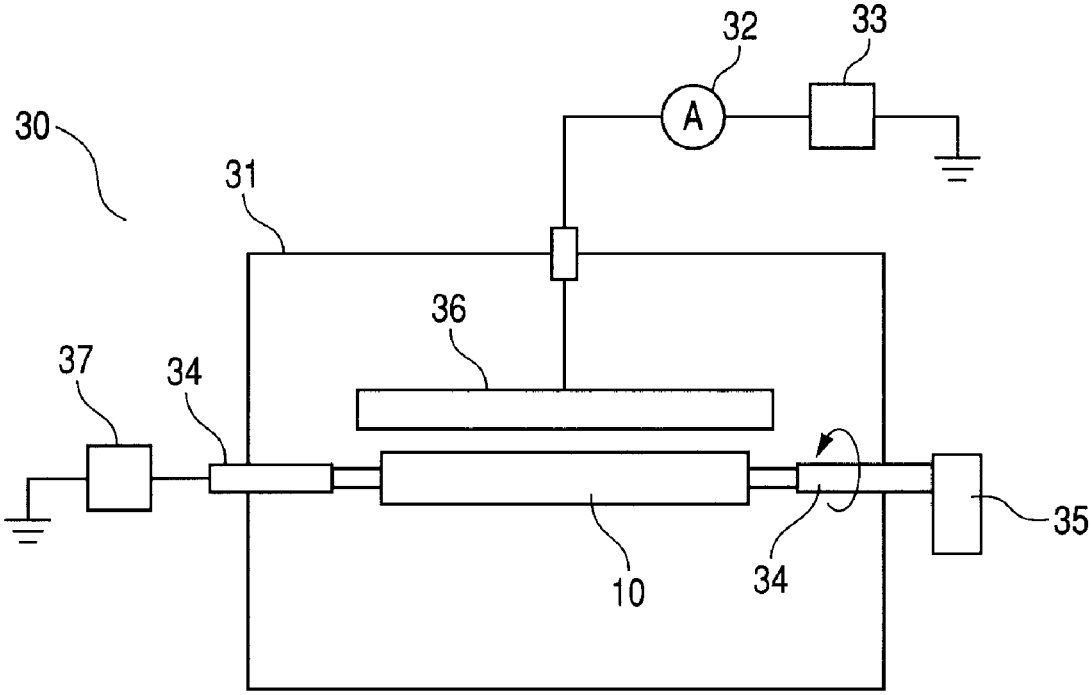
FIG. 3 is a schematic structural view showing an example of a corona discharge treatment apparatus according to the present invention.

About a corona discharge treatment apparatus applicable to the present invention, its outline is described with reference to FIG. 3. FIG. 3 is a schematic structural view showing an example of a corona discharge treatment apparatus that materializes the process for producing the roller for the electrophotography of the present invention and the process for making the conductive roller low in electric resistance. In what is shown in FIG. 3, a corona discharge treatment apparatus 30 is constituted of a chamber 31, a corona ammeter 32, a high-frequency power source 33, supports 34, a rotary drive 35, a corona electrode 36 and a direct-current bias power source 37. Such a corona discharge treatment apparatus may include as an example a corona discharge surface treatment apparatus (manufactured by Kasuga Electric Works Ltd.).

The treatment object roller 10 for the electrophotography is placed in the chamber 31, and is supported by the supports 34 on both end portions of the mandrel so as to place in parallel with the corona electrode 36 having a desired distance. Further, the mandrel of the roller 10 for the electrophotography is connected to the direct-current bias power source 37 through one of the supports 34, and also connected to the rotary drive 35 on the other support. The corona electrode 36 is electrically insulated from the chamber 31, and is further connected with the high-frequency power source 33, which outputs a high-frequency power having a desired frequency. The corona ammeter 32 is connected between the corona electrode 36 and the high-frequency power source 33, thus the value of electric current supplied to corona discharge can be measured. As the corona electrode 36, in order to keep any abnormal discharge from occurring, an electrode may preferably be used which is constituted of a metallic conductor which supplies the high-frequency power and an insulator which covers the former around it. There are no particular limitations on the conductor as long as it is a conductive material, and it is preferable to use therefor a metal such as Al and Cu. There are no particular limitations on the insulator as long as it is an insulating material, and it is preferable in view of durability to use a ceramic. In the present invention, any desired bias may be applied from the direct-current bias power source 37 to the conductive mandrel of the roller 10 for the electrophotography.

How the corona discharge treatment apparatus operates is described next. First, the roller 10 for the electrophotography to be subjected to corona discharge treatment is placed at a desired position. Next, this roller 10 for the electrophotography is rotated at a desired number of revolutions. Then, any desired bias is applied from the direct-current bias power source 37 to the conductive mandrel of the roller 10 for the electrophotography. Thereafter, a desired high-frequency power is supplied to the corona electrode 36 from the high-frequency power source 33 to cause corona discharge between the roller 10 for the electrophotography and the corona electrode 36 to start the treatment. Upon lapse of a desired treatment time, the supply of electric power and the rotating drive are stopped and then the roller 10 for the electrophotography is taken out to complete the treatment.

The corona discharge may be caused to take place under conditions that may preferably appropriately be controlled so as to be able to succeed in making low in electric resistance as desired. The corona discharge treatment may be carried out for a time that may preferably appropriately be selected in order to succeed in making low in electric resistance as desired. Stated specifically, the treatment may preferably be carried out for a time of from 30 seconds or more to 300 seconds or less. Inasmuch as it is done for not less than 30 seconds, the effect of uniform treatment can be obtained in the peripheral direction as being preferable. Also, inasmuch as it is done for not more than 300 seconds, the elastic layer can be kept from being damaged because of any excess temperature rise, as being preferable. In causing the corona discharge to take place, the inside of the chamber may be set at any pressure without any particular limitations. In order to make higher the density of charged particles during the corona discharge to carry out the treatment in a good efficiency, it is preferable to form the corona discharge at a pressure vicinal to atmospheric pressure, of from 92 kPa to 111 kPa to carry out the treatment.

As the high-frequency power to be supplied to the corona electrode 36, it is preferable to appropriately select its frequency and the electric power to be applied. Stated specifically, the frequency may preferably be within the range of form 1 kHz to 3 GHz. Also, where the corona discharge is caused to take place in the atmosphere, it may preferably be from 1 kHz to 15 MHz, and particularly from 5 kHz to 100 kHz, because the corona discharge can stably be formed. The electric power to be applied depends on how the apparatus is set up and the region over which the corona discharge is caused to take place, and is not particularly limited, but may preferably be set high as long as any abnormal discharge does not occur and any excess temperature rise is not caused. This is because making low in electric resistance can be achieved in a short time.

In the present invention, it is preferable that a positive bias is applied from the direct-current bias power source 37 to the conductive mandrel of the roller 10 for the electrophotography to carry out the corona discharge treatment. Stated specifically, it may preferably be applied within the range of from +10 V to +300 V. Inasmuch as it is done at not less than +10 V, the silica particles can be retained in a high density on the roller surface as being preferable. Inasmuch as it is done at not more than +300 V, any abnormal discharge can be kept from occurring, as being preferable.

The corona electrode 36 and the roller 10 for the electrophotography may be at any distance between them without any particular limitations, as long as it is substantially uniform in the lengthwise direction. The distance therebetween may be selected in a proper range according to the power source frequency to be used, so as for the corona discharge to be stably formed. In general, the distance therebetween may preferably be set at from 1 mm to 10 mm. Inasmuch as it is set at not less than 1 mm, any abnormal discharge can be kept from occurring, as being preferable. Also, inasmuch as it is set at not more than mm, the corona discharge can uniformly be formed as being preferable. It is preferable for the corona discharge treatment to be carried out uniformly in the peripheral direction while rotating the roller 10 for the electrophotography. The roller 10 for the electrophotography may preferably be rotated at a number of revolutions of approximately from 60 rpm or more to 3,000 rpm or less.

<Resistance Measuring Instrument>

Figure 4:
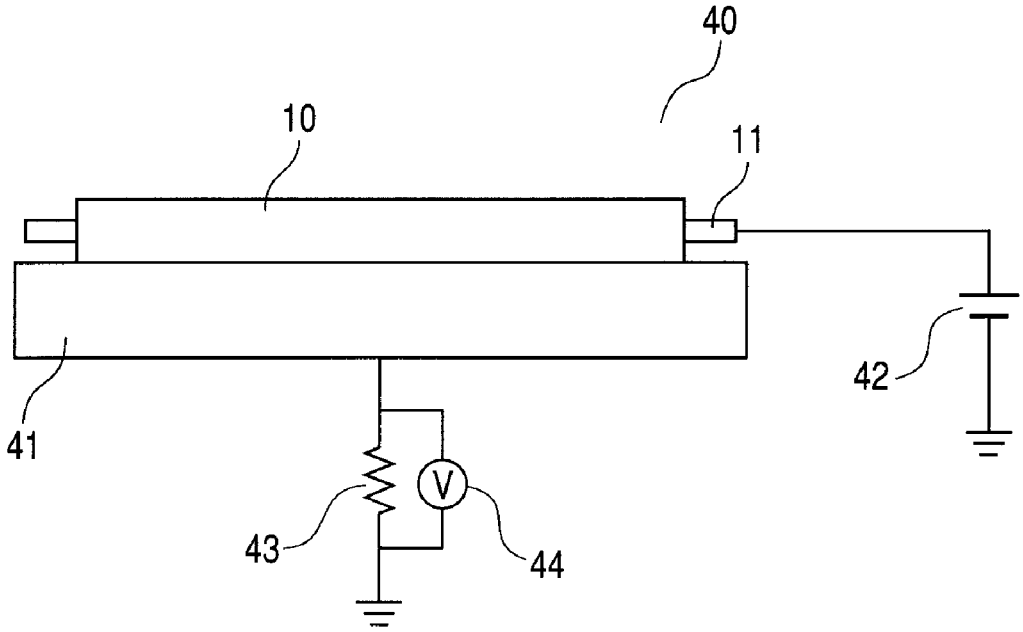
FIG. 4 is a schematic structural view showing an example of a resistance measuring instrument according to the present invention.

Having made the roller for the electrophotography low in electric resistance may be ascertained by using a resistance measuring instrument 40 shown in FIG. 4. In what is shown in FIG. 4, the resistance measuring instrument 40 is constituted of a metallic electrode 41, a direct-current power source 42 connected to a mandrel 11 of a roller 10 for the electrophotography, and an internal resistance 43 and a voltmeter 44 which are each connected to the metallic electrode 41. The metallic electrode 41 is so provided as to come into contact with the roller 10 for the electrophotography in its whole lengthwise direction. The metallic electrode 41 is rotatingly drivable by a drive motor (not shown). As the direct-current power source 42, a small-sized power source PL-650-0.1 (trade name; manufactured by Matsusada Precision Inc.) is used. Also, as the voltmeter 44, a digital multi-meter (trade name: FLUKE 83; manufactured by Fluke Corporation) is used.

The procedure for operating the resistance measuring instrument 40 is described next. In the resistance measuring instrument 40, placed in an environment of temperature 23° C. and humidity 50% RH, the roller 10 for the electrophotography is placed in the state it is brought into contact with the metallic electrode 41 under a stated load. The load is set on both ends of the mandrel 11, as a load of 500 g each, i.e., a load of 1 kg in total. Next, the metallic electrode 41 is rotatingly driven, and its number of revolutions is adjusted, which is so adjusted that the number of revolutions of the roller 10 for the electrophotography, which is follow-up rotated, may come to 32 rpm. A voltage of 50 V is applied to the mandrel 11 by the direct-current power source 42. At this point, the resistance values of the roller 10 for the electrophotography at its both end portions and middle portion are measured in the following way. Voltages Vr at both ends of the internal resistance 43 connected to the metallic electrode 41 are measured with the voltmeter 44. Resistance value R (Ω) of the internal resistance 43 may appropriately be so selected that the voltage measured with the voltmeter 44 may come to 0.1 V to 1 V. Measurement voltage Vr (V) is taken as an average value of voltages for 3 seconds upon lapse of 3 seconds after application of the voltage. Resistance value Rr (Ω) of the roller 10 for the electrophotography is found according to the following expression (2).

$$Rr=R\times(50/Vr-1) \qquad \text{Expression (2)}$$

<Electrophotographic Image Forming Apparatus and Electrophotographic Process Cartridge>

Figure 5:
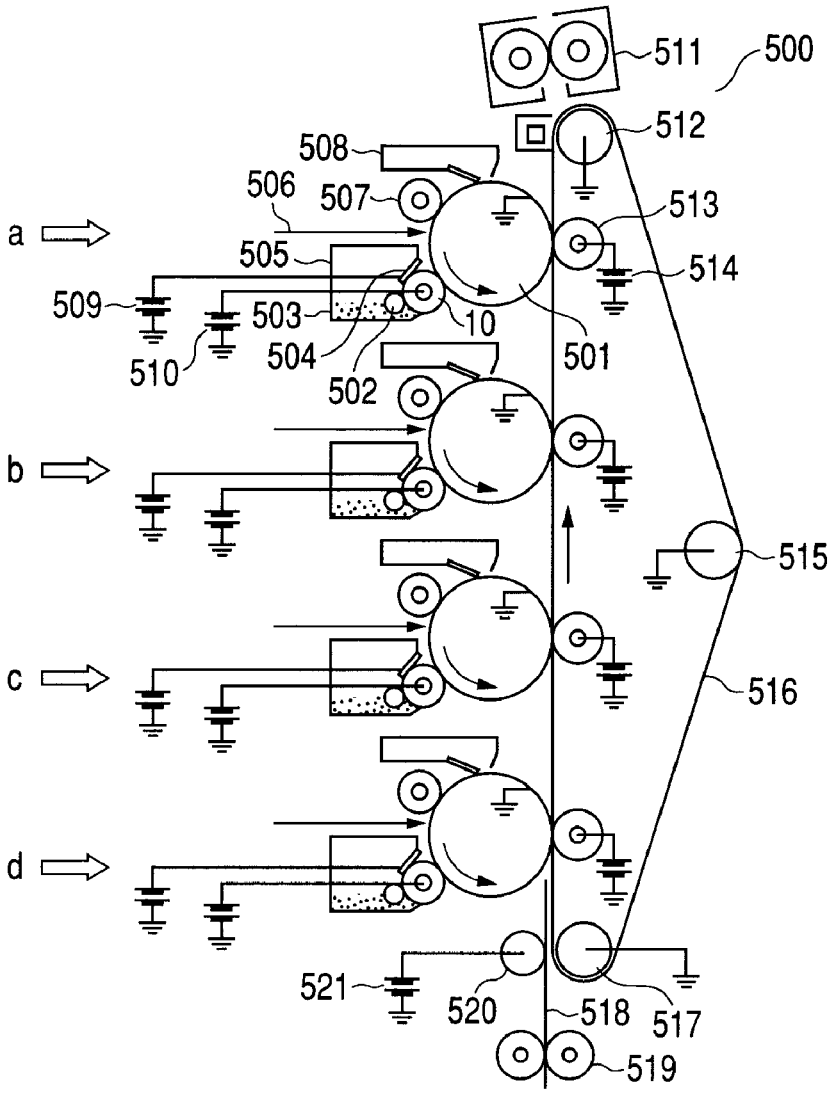
FIG. 5 is a schematic structural view showing an example of an electrophotographic image forming apparatus according to the present invention.

An electrophotographic image forming apparatus making use of the roller for the electrophotography as at least one of a charging member and a developing member has a photosensitive member on which electrostatic latent images are to be formed, a charging member which charges the photosensitive member electrostatically, and a developing member which develops the electrostatic latent images formed on the photosensitive member. An example of the electrophotographic image forming apparatus in which the roller for the electrophotography of the present invention is mounted is described with reference to FIG. 5. An example of such an electrophotographic image forming apparatus in the present invention is shown in FIG. 5. In what is shown in FIG. 5, an electrophotographic image forming apparatus 500 is provided with image forming units a, b, c and d which are provided for each of respective-color toners of a yellow toner, a magenta toner, a cyan toner and a black toner. The respective image forming units are each provided with a photosensitive member 501 as an electrostatic latent image bearing member which is rotated in the direction of an arrow. Each photosensitive member is provided around it with a charging apparatus 507 for uniformly charging the photosensitive member electrostatically, an exposure means which exposes the photosensitive member having been thus processed by uniform charging, to laser beams 506 to form the electrostatic latent images thereon, and a developing apparatus 505 which feeds the toner to the photosensitive member on which the electrostatic latent images have been formed, to develop the electrostatic latent images. Meanwhile, a transfer transport belt 516 which transports a recording material 518 such as a paper sheet, fed by means of a paper feed roller 519, is provided in the state it is put over a drive roller 512, a follower roller 517 and a tension roller 515. To the transfer transport belt 516, electric charges from an attraction bias power source 521 are applied through an attraction roller 520 so that the recording material 518 can be transported in the state it is kept electrostatically attracted to the surface of the belt. A transfer bias power source 514 is also provided which applies electric charges for transferring a toner image on the photosensitive member in each image forming unit to the recording material 518 transported by the transfer transport belt 516. The transfer bias is applied through a transfer roller 513 disposed on the back side of the transfer transport belt 516. Respective-color toner images formed in the respective image forming units are so made as to be successively superimposed on and transferred to the recording material 518 transported by the transfer transport belt 516, which is driven in synchronization with the operation of the image forming units. Such a color electrophotographic image forming apparatus is further provided with a fixing apparatus 511 which fixes, by heating and so forth, the toner images having been superimposed on and transferred to the recording material, and a transport apparatus (not shown) which delivers out of the apparatus the recording material on which a fixed image has been formed. Meanwhile, each image forming unit is provided with a cleaning apparatus 508 having a cleaning blade with which any transfer residual toner remaining on each photosensitive member without being transferred therefrom is removed to clean the surface. Besides, it is further provided with a waste toner container (not shown) which receives the toner scraped off the photosensitive member. The photosensitive member thus cleaned is put into a state feasible for image formation so as to stand by for next image formation.

The developing apparatus 505 provided in each of the image forming units is provided with a toner container 503 which holds therein a non-magnetic toner as a one-component developer, and a developing roller 10 which is so disposed as to close an opening of the toner container and in such a way as to face the photosensitive member at the part where the roller stands uncovered from the toner container. The toner container is provided therein with a toner feed roller 502 and a developing agent regulating blade 504 made of SUS304 stainless steel. The toner feed roller 502 is provided in order to feed the toner to the developing roller and at the same time scrape any toner off which remains on the developing roller after the development without being used. The developing agent regulating blade 504 is provided in order to form the toner on the developing roller in the form of a thin layer and also charge it triboelectrically. These are each disposed in contact with the developing roller 10. A developing agent regulating blade bias power source 509 is connected to the developing agent regulating blade 504, and a developing roller bias power source 510 is connected to the developing roller, where a voltage is applied to each of the developing agent regulating blade 504 and the developing roller 10 when images are formed. The voltage to be outputted from the developing agent regulating blade bias power source 509 is set lower by 50 V to 400 V than the voltage to be outputted from the developing roller bias power source 510. This difference in voltage may be set taking account of the amount of the developer to be fed onto the developing roller 10 and the quantity of triboelectricity.

Figure 6:
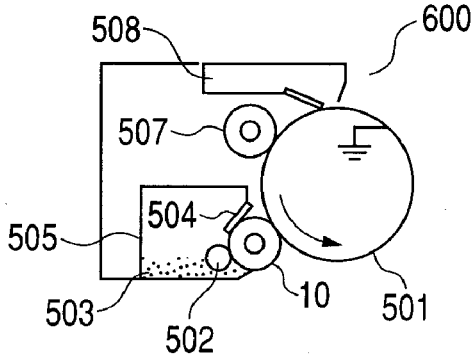
FIG. 6 is a schematic structural view showing an example of an electrophotographic process cartridge according to the present invention.

An electrophotographic process cartridge making use of the roller for the electrophotography as at least one of a charging member and a developing member has a photosensitive member on which electrostatic latent images are to be formed, a charging member which charges the photosensitive member electrostatically, and a developing member which develops the electrostatic latent images formed on the photosensitive member. The electrophotographic process cartridge may be used in the form of being detachably mountable to the main body of the electrophotographic image forming apparatus. A cross section of a process cartridge having the developing roller of the present invention is shown in FIG. 6. A process cartridge 600 has a developing apparatus 505, a photosensitive member 501 and a cleaning apparatus 508, and these are joined together and are so set up as to be detachably mountable to the main body of the electrophotographic image forming apparatus.

EXAMPLES

The present invention is described below in greater detail by giving Examples and Comparative Examples.

Example 1

Production of Roller for Electrophotography

A roller for an electrophotography having a columnar conductive mandrel and formed on the circumference thereof, as cover layers, an elastic layer and a resin layer as a surface layer which were each a single layer was produced according to the following procedure. As the conductive mandrel, a mandrel was used which was 6 mm in diameter and 279 mm in length and made of SUS304 stainless steel. As a material for the elastic layer, a liquid silicone rubber was readied in the following way. First, materials shown in Table 2 were mixed to prepare a base material of the liquid silicone rubber.

TABLE 2

| Materials | Parts by mass |
|---|---|
| Dimethyl polysiloxane having vinyl groups at both terminals and a viscosity of 100 Pa · s at temperature 25° C. (available from Dow Corning Toray Silicone Co., Ltd.; weight average molecular weight: 100,000) | 100 |
| Quartz powder (filler) (trade name: Min-USil; available from Pennsylvania Glass Sand Corporation) | 7 |
| Carbon black (trade name: DENKA BLACK, powdery product; available from Denki Kagaku Kogyo Kabushiki Kaisha) | 7 |

Next, what was prepared by blending the above base material with a trace amount of a platinum compound (available from Dow Corning Toray Silicone Co., Ltd.; Pt concentration: 1%) as a curing catalyst and what was prepared by blending the above base material with 3 parts by mass of an organohydrogenpolysiloxane (available from Dow Corning Toray Silicone Co., Ltd.; weight average molecular weight: 500) were mixed in a mass ratio of 1:1 to obtain the liquid silicone rubber.

The conductive mandrel was placed at the center in a cylindrical mold of 12 mm in inner diameter, and the above liquid silicone rubber was casted into the cylindrical mold through its casting inlet, and then cured by heating at a temperature of 120° C. for 5 minutes, followed by cooling to room temperature. Thereafter, an elastic layer joined together with the conductive mandrel was demolded. This was further heated at a temperature of 150° C. for 4 hours to complete the curing reaction, thus the conductive mandrel was provided on the periphery thereof with an elastic layer of 3 mm in thickness, composed chiefly of silicone rubber.

Next, the elastic layer was subjected to excimer treatment on its surface. More specifically, while the conductive mandrel was rotated as a rotating shaft at 30 rpm, the surface of the elastic layer was irradiated with ultraviolet rays by using a capillary excimer lamp (manufactured by Harison Toshiba Lighting Corporation) capable of emitting ultraviolet rays of 172 nm in wavelength and in such a way that the integrated amount of light on the surface of the elastic layer came to 120 $mJ/cm^2$. During this irradiation, the distance between the elastic layer surface and the excimer lamp was set to 2 mm. On the elastic layer surface having been subjected to excimer treatment, the resin layer was formed. As materials for the resin layer, those shown in Table 3 were used.

TABLE 3

| Materials | Parts by mass |
|---|---|
| Polytetramethylene glycol [trade name: PTG650SN; available from Hodogaya Chemical Co., Ltd.; number average molecular weight Mn: 1,000; f: 2 (f represents the number of functional groups; the same applies hereinafter)] | 100 |

TABLE 3-continued

| Materials | Parts by mass |
|---|---|
| Isocyanate (trade name: MILLIONATE MT, MDI; available from Nippon Polyurethane Industry Co., Ltd.; f: 2) | 21.2 |

The materials shown in Table 3 were stepwise mixed in a methyl ethyl ketone solvent, and then allowed to react at 80 degrees for 6 hours in an atmosphere of nitrogen. As the result, a bifunctional polyurethane prepolymer was obtained which had a weight average molecular weight Mw of 10,000, a hydroxyl value of 20.0 (mg·KOH/g), a degree of molecular weight dispersion Mw/Mn of 2.9 and an Mz/Mw of 2.5.

To 100.0 parts by mass of this polyurethane prepolymer, 35.0 parts by mass of an isocyanate (trade name: COLONATE 2521; available from Nippon Polyurethane Industry Co., Ltd.) so as to be in an NCO equivalent weight of 1.4. Incidentally, the NCO equivalent weight is one showing the ratio of the number of moles of isocyanate groups in the isocyanate compound to the number of moles of hydroxyl groups in the polyol component ([NCO]/[OH]). Further, 21.0 parts by mass of carbon black (trade name: #1000; pH: 3.0; available from Mitsubishi Chemical Corporation) was added. To the raw-material liquid mixture obtained, an organic solvent was added to adjust its solid content to 20% by mass so that a film of about 15 μm in layer thickness was obtainable. Further, 35.0 parts by mass of urethane resin particles (trade name: C400 Transparent; particle diameter: 14 μm; available from Negami Chemical Industrial Co., Ltd.) was added thereto, and these were uniformly dispersed and mixed to obtain a resin layer forming coating material. In this coating material, the conductive mandrel with the elastic layer formed thereon as above was dipped, and thereafter this was drawn up and then dried naturally to form a coating film of the coating material on the surface of the elastic layer. Next, this conductive mandrel having the elastic layer on the surface of which the coating film was formed was heated at a temperature of 140° C. for 60 minutes to cure the coating film to form a resin layer of 15.0 μm in layer thickness. Further, both end portions of the cover layers formed were cut perpendicularly to the conductive mandrel to adjust the length of the cover layers to 235 mm. Thus, a roller for an electrophotography was produced which was about 12 mm in outer diameter, 235 mm in length of the cover layers, and 1.7 μm in center-line average roughness Ra according to the surface roughness standard of JIS B0601:1994. Further, the resistance value of the roller for the electrophotography thus produced was measured with the resistance measuring instrument described previously. As the result, the resistance value was found to be $5.0\times10^5\Omega$.

<Use of Roller for Electrophotography>

Using as a developing roller the roller for the electrophotography thus obtained, images were reproduced on an electrophotographic image forming apparatus (trade name: COLOR LASER JET 3600; manufactured by Hewlett-Packard Co.). A cartridge exclusively used for black was readied as the electrophotographic process cartridge, and was used after only the developing agent regulating blade 504 was changed for one made of SUS304 stainless steel, having a thickness of 100 μm. This was left to stand in an environment of temperature 15.0° C. and humidity 10% RH for 24 hours. Thereafter, this electrophotographic process cartridge was mounted to the main body of the electrophotographic image forming apparatus, and images with a print percentage of 1% were reproduced in the environment of temperature 15.0° C. and humidity 10% RH until the developer residue in the cartridge came to 20 g. Here, to the developing agent regulating blade 504, a voltage that was lower by 200 V than the voltage outputted from the developing roller bias power source 510 was applied from the developing agent regulating blade bias power source 509 when used. Any deposits of developer origin which stood adherent to the surface of the roller for the electrophotography after its use were removed by air blowing, and thereafter a pressure-sensitive adhesive tape (trade name: SCOTCH MENDING TAPE; available from Sumitomo 3M Limited) was used to clean the whole roller surface. To clean it, the surface was repeatedly cleaned until the pressure-sensitive adhesive tape came no longer colored with the deposits. Thereafter, the resistance value of the roller for the electrophotography after use was measured with the resistance measuring instrument described previously. As the result, the resistance value (R1) of the roller for the electrophotography after use was found to be $2.0\times10^{7}\Omega$. Thus, it was ascertained that the electric resistance became high as a result of its use in reproducing images by using the electrophotographic image forming apparatus.

<Attaching Silica Particles to Roller for Electrophotography>

Next, using the silica particles attaching apparatus described previously, the silica particles were attached to the surface layer of the roller for the electrophotography after use. In the silica particles attaching apparatus, a silica particles feed roller was placed which was made to uniformly hold silica particles having an average primary particle diameter of 100 nm, and further the roller for the electrophotography after use was so placed that the level of penetration into the silica particles feed roller came to 2 mm. As the foamed elastic layer of the silica particles feed roller, a foamed elastic layer was used in which the cells standing open to the surface had an opening diameter of 0.1 mm on the average and being 50% in area ratio to the surface area of the foamed elastic layer. Thereafter, the silica particles feed roller and the roller for the electrophotography after use were rotatingly driven in the direction of the arrow in FIG. 2, by the motor connected to each of them, to attach the silica particles to the surface of the roller for the electrophotography after use. Here, the silica particles feed roller and the roller for the electrophotography after use were rotatingly driven at numbers of revolutions of 30 rpm and 120 rpm, respectively, for 10 seconds. As the result, the silica particles were attached to the roller for the electrophotography in an amount of 0.020 $mg/cm^2$.

<Corona Discharge Treatment of Roller for Electrophotography>

Next, the roller for the electrophotography to the surface layer of which the silica particles were attached was subjected to corona discharge treatment on its surface by using the corona discharge treatment apparatus described previously. In the corona discharge treatment apparatus, the roller for the electrophotography was so placed as to be at a distance of 2 mm between it and the corona electrode. A corona electrode was used the conductor of which was made of Al and the insulator of which was made of ceramic. Thereafter, the roller for the electrophotography was rotatingly driven at a number of revolutions of 600 rpm. Next, a positive bias of +100 V was kept applied to the conductive mandrel and then a high-frequency power of 10 kHz was supplied under atmospheric pressure and at an applied electric power of 200 W to cause the corona discharge to take place to carry out the corona discharge treatment for 30 seconds to the surface layer of the roller for the electrophotography. Thereafter, the electric resistance (R2) of the roller for the electrophotography having been subjected to the corona discharge treatment was measured with the resistance measuring instrument described previously. As the result, it had an electric resistance (R2) of $5.0\times10^{5}\Omega$. Here, the electric resistance (R2) after the treatment for decreasing the electric resistance was divided by the electric resistance (R1) before the corona discharge treatment to calculate the rate of decreasing in electric resistance, R2/R1. In this Example, the rate of decreasing in electric resistance, R2/R1, was found to be 0.0250. From the fact that the value of R2/R1 was less than 1.000, it was able to ascertain that the treatment for decreasing in electric resistance was able to make the surface layer decrease in electric resistance. As the degree of treatment for decreasing in electric resistance, the value of R2/R1 may be taken as a standard, which may preferably be within the range of from 0.002 or more to 0.05 or less. Inasmuch as it is not less than 0.002, any image defects can be kept from being caused by leakage when images are formed. Inasmuch as it is not more than 0.05, the density of images can be kept from varying when images are formed. It may further preferably be within the range of from 0.005 or more to 0.04 or less.

<Evaluation by Electrophotographic Image Forming Apparatus>

(Evaluation on Change in Image Density)

Next, the roller for the electrophotography having been decreased in electric resistance was again used as the developing roller, and images were evaluated by using the like electrophotographic image forming apparatus. A cartridge exclusively used for black was likewise readied as the electrophotographic process cartridge, and was used after only the developing agent regulating blade 504 was changed for one made of SUS304 stainless steel, having a thickness of 100 μm. This was left to stand in an environment of temperature 15° C. and humidity 10% RH for 24 hours. Thereafter, this electrophotographic process cartridge was mounted to the main body of the electrophotographic image forming apparatus, and solid black images were continuously reproduced on 10 sheets in the environment of temperature 15° C. and humidity 10% RH to make evaluation on any change in image density. Here, in this evaluation as well, to the developing agent regulating blade 504, a voltage that was lower by 200 V than the voltage outputted from the developing roller bias power source 510 was applied from the developing agent regulating blade bias power source 509 when used. For the change in image density, a reflection densitometer (trade name: GretagMacbeth RD-918; manufactured by GretagMacbeth Ag.) was used to measure reflection density on the first sheet and that on the 10th sheet, and a difference between them was taken as the value of change in image density. Reflection densities were measured at arbitrary 9 spots on the whole image surface, and an average value thereof was taken as the reflection density. Where the solid black images are continuously reproduced using as a developing roller a roller for an electrophotography which is left having become high in electric resistance, the roller for the electrophotography becomes gradually high in its surface potential, so that the image density may inevitably vary. Accordingly, the value of change in image density can be used as an index of making the roller for the electrophotography low in electric resistance. About the value of change in image density, evaluation was made according to criteria shown in Table 4. Here, it is considered that, the smaller the value of change in image density is, the better the effect of decreasing in electric resistance has been obtained. Also, the following evaluation ranks A and B show levels where any change in image density is not visually perceivable. On the other hand, the following evaluation ranks C and D show levels where the change in image density is clearly visually perceivable.

TABLE 4

| Rank | |
|---|---|
| A | Smaller than 0.03. |
| B | Not smaller than 0.03 to smaller than 0.05. |
| C | Not smaller than 0.07 to smaller than 0.10 |
| D | Not smaller than 0.10. |

(Evaluation on Leakage)

Next, in the like environment of temperature 15° C. and humidity 10% RH, halftone images were reproduced by using the same electrophotographic process cartridge and the same electrophotographic image forming apparatus as the above, to make evaluation on leakage. In this evaluation, to the developing agent regulating blade 504, a voltage that was lower by 250 V than the voltage outputted from the developing roller bias power source 510 was applied from the developing agent regulating blade bias power source 509 when used. If the phenomenon of short-circuit leakage occurs because of the discharge during the treatment for making low in electric resistance, image defects tend to occur which are caused by a leakage phenomenon in which the developing roller bias varies when images are formed. Especially where a blade bias is applied to the developing agent regulating blade so as to provide a potential difference from development bias, leakage current may flow to make the development bias vary to tend to cause horizontal line-like image defects. Accordingly, the extent of such horizontal lines can be used as an index of any difficulties of leakage caused by making the roller for the electrophotography low in electric resistance. To make the evaluation on leakage, whether or not any horizontal lines appeared on the halftone images was visually judged, and thereafter a density difference between horizontal lines areas and normal areas was measured with a reflection densitometer (trade name: GretagMacbeth RD918; manufactured by GretagMacbeth Ag.) to make evaluation according to criteria shown in Table 5. Here, the following evaluation ranks A and B show levels of no problem in practical use. On the other hand, the following evaluation ranks C and D show levels where the density difference was clearly visually perceivable.

TABLE 5

| Rank | |
|---|---|
| A | Any horizontal lines were seen. |
| B | Horizontal lines were seen. The density difference was less than 0.03. |
| C | Horizontal lines were seen. The density difference was 0.05 or more to less than 0.1. |
| D | Horizontal lines were seen. The density difference was 0.1 or more. |

The results of evaluation in the foregoing are shown in Table 6.

Comparative Example 1

A roller for an electrophotography was produced in the same way as that in Example 1, and was likewise used in the electrophotographic image forming apparatus. The resistance value R1 of the roller for the electrophotography after use was $2.0\times10^{7}\Omega$. Next, the roller was evaluated in the same way as that in Example 1 except that the attaching of silica particles and the corona discharge treatment were both not carried out. The resistance value R2 at the time of evaluation was $2.0\times10^{7}\Omega$.

Comparative Example 2

A roller for an electrophotography was produced in the same way as that in Example 1, and was likewise used in the electrophotographic image forming apparatus. The resistance value R1 of the roller for the electrophotography after use was $2.0\times10^{7}\Omega$. Next, the roller was evaluated in the same way as that in Example 1 except that the attaching of silica particles was not carried out and only the corona discharge treatment was carried out. The resistance value R2 after the corona discharge treatment was $2.0\times10^{4}\Omega$.

Example 2

A roller for an electrophotography was produced in the same way as that in Example 1, and was likewise used in the electrophotographic image forming apparatus. The resistance value R1 of the roller for the electrophotography after use was $2.0\times10^{7}\Omega$. Next, the roller was evaluated in the same way as that in Example 1 except that the silica particles were attached in an amount changed to 0.003 mg/cm$^2$ and then the corona discharge treatment was carried out. The R2 after the corona discharge treatment was $8.0\times10^{4}\Omega$.

Example 3

A roller for an electrophotography was produced in the same way as that in Example 1, and was likewise used in the electrophotographic image forming apparatus. The resistance value R1 of the roller for the electrophotography after use was $2.0\times10^{7}\Omega$. Next, the roller was evaluated in the same way as that in Example 1 except that the silica particles were attached in an amount changed to 0.005 mg/cm$^2$ and then the corona discharge treatment was carried out. The R2 after the corona discharge treatment was $1.0\times10^{5}\Omega$.

Example 4

A roller for an electrophotography was produced in the same way as that in Example 1, and was likewise used in the electrophotographic image forming apparatus. The resistance value R1 of the roller for the electrophotography after use was $2.0\times10^{7}\Omega$. Next, the roller was evaluated in the same way as that in Example 1 except that the silica particles were attached in an amount changed to 0.020 mg/cm$^2$ and then the corona discharge treatment was carried out. The R2 after the corona discharge treatment was $3.0\times10^{5}\Omega$.

Example 5

A roller for an electrophotography was produced in the same way as that in Example 1, and was likewise used in the electrophotographic image forming apparatus. The resistance value R1 of the roller for the electrophotography after use was $2.0\times10^{7}\Omega$. Next, the roller was evaluated in the same way as that in Example 1 except that the silica particles were attached in an amount changed to 0.100 mg/cm$^2$ and then the corona discharge treatment was carried out. The R2 after the corona discharge treatment was $8.0\times10^{5}\Omega$.

Example 6

A roller for an electrophotography was produced in the same way as that in Example 1, and was likewise used in the electrophotographic image forming apparatus. The resistance value R1 of the roller for the electrophotography after use was $2.0\times10^{7}\Omega$. Next, the roller was evaluated in the same way as that in Example 1 except that the silica particles were attached in an amount changed to 0.150 mg/cm$^2$ and then the corona discharge treatment was carried out. The R2 after the corona discharge treatment was $1.0\times10^6\Omega$.

Example 7

A roller for an electrophotography was produced in the same way as that in Example 1, and was likewise used in the electrophotographic image forming apparatus. The resistance value R1 of the roller for the electrophotography after use was $2.0\times10^7\Omega$. Next, the roller was evaluated in the same way as that in Example 1 except that the silica particles were attached in an amount changed to 0.003 mg/cm$^2$ and the corona discharge treatment was carried out under application of a positive bias of +10 V to the conductive mandrel. The R2 after the corona discharge treatment was $4.0\times10^5\Omega$.

Example 8

A roller for an electrophotography was produced in the same way as that in Example 1, and was likewise used in the electrophotographic image forming apparatus. The resistance value R1 of the roller for the electrophotography after use was $2.0\times10^7\Omega$. Next, the roller was evaluated in the same way as that in Example 1 except that the silica particles were attached in an amount changed to 0.003 mg/cm$^2$ and the corona discharge treatment was carried out under application of a positive bias of +100 V to the conductive mandrel. The R2 after the corona discharge treatment was $5.0\times10^5\Omega$.

Example 9

A roller for an electrophotography was produced in the same way as that in Example 1, and was likewise used in the electrophotographic image forming apparatus. The resistance value R1 of the roller for the electrophotography after use was $2.0\times10^7\Omega$. Next, the roller was evaluated in the same way as that in Example 1 except that the silica particles were attached in an amount changed to 0.003 mg/cm$^2$ and the corona discharge treatment was carried out under application of a positive bias of +300 V to the conductive mandrel. The R2 after the corona discharge treatment was $5.0\times10^5\Omega$.

Example 10

A roller for an electrophotography was produced in the same way as that in Example 1, and was likewise used in the electrophotographic image forming apparatus. The resistance value R1 of the roller for the electrophotography after use was $2.0\times10^7\Omega$. Next, the roller was evaluated in the same way as that in Example 1 except that the silica particles were attached in an amount changed to 0.003 mg/cm$^2$ and the corona discharge treatment was carried out under application of a positive bias of −100 V to the conductive mandrel. The R2 after the corona discharge treatment was $8.0\times10^4\Omega$.

Example 11

From a cartridge exclusively used for black of an electrophotographic image forming apparatus (trade name: COLOR LASER JET 3600; manufactured by Hewlett-Packard Co.), its charging roller was taken out, and was evaluated as a roller for an electrophotography. The charging roller had the conductive mandrel and the conductive surface layer containing a resin and a carbon black dispersed in the resin, and had a resistance value of $2.0\times10^5\Omega$ before use. This was again incorporated as the charging roller in a cartridge exclusively used for black in which only the developing agent regulating blade was changed for the one like that in Example 1, and images were reproduced under the same conditions as those in Example 1. The R1 of the roller for the electrophotography after its use as the charging roller was $5.0\times10^6\Omega$. Thus, it was ascertained that the electric resistance became high as a result of its use in reproducing images by using the electrophotographic image forming apparatus. Next, in the same way as that in Example 1, the silica particles were so attached to the surface of the roller for the electrophotography as to be in the like amount of 0.020 mg/cm$^2$, and thereafter this surface was subjected to corona discharge treatment under the same conditions as those in Example 1. The R2 after the corona discharge treatment was $2.0\times10^5\Omega$. Thus, it was seen to have been able to make the surface layer low in electric resistance. Next, the roller for the electrophotography having been made low in electric resistance was again used as the charging roller, and images were evaluated by using the like electrophotographic image forming apparatus in the same way as that in Example 1. A cartridge exclusively used for black was anew likewise readied as the electrophotographic process cartridge, and was used after only the developing agent regulating blade 504 was changed for one made of SUS304 stainless steel, having a thickness of 100 μm.

Where solid black images are continuously reproduced using as a charging roller a roller for an electrophotography which has become high in electric resistance, the photosensitive member becomes gradually high in its surface potential, so that the image density may inevitably vary. Accordingly, the value of change in image density can be used as an index of making the roller for the electrophotography low in electric resistance. The evaluation on change in image density was made according to the same criteria as those in Example 1.

If the phenomenon of short-circuit leakage occurs because of the discharge during the treatment for making low in electric resistance, horizontal line-like image defects tend to occur which are caused by the leakage phenomenon in which the drum potential varies when images are formed. Accordingly, the extent of such horizontal lines can be used as an index of any difficulties of leakage caused by making the roller for the electrophotography low in electric resistance. The evaluation on leakage was made according to the same criteria as those in Example 1.

Comparative Example 3

A charging roller was taken out in the same way as that in Example 11, and was evaluated as a roller for an electrophotography. Its resistance value before use was $2.0\times10^5\Omega$. Like Example 11, the R1 of the roller for the electrophotography after its use as the charging roller was $5.0\times10^6\Omega$. Next, the roller was evaluated in the same way as that in Example 11 except that the attaching of silica particles and the corona discharge treatment were not carried out. The R2 at the time of evaluation was $5.0\times10^6\Omega$.

Comparative Example 4

A charging roller was taken out in the same way as that in Example 11, and was evaluated as a roller for an electrophotography. Its resistance value before use was $2.0\times10^5\Omega$. Like Example 11, the R1 of the roller for the electrophotography after its use as the charging roller was $5.0\times10^6\Omega$. Next, the roller was evaluated in the same way as that in Example 1 except that the corona discharge treatment was carried out without attaching the silica particles. The R2 after the corona discharge treatment was $4.0\times10^{3}\Omega$.

Example 12

Like Example 1, a roller was produced which had a columnar conductive mandrel and provided on the periphery thereof, as cover layers, an elastic layer and a resin layer which were each a single layer. This was produced under the same conditions as those in Example 1 except that the amount of the carbon black (trade name: #1000; pH: 3.0; available from Mitsubishi Chemical Corporation) added, used in the resin layer, was changed to 16.0 parts by mass. The resistance value R1 of the roller produced was $3.0\times10^{7}\Omega$. Next, the treatment of making the resin layer low in electric resistance was carried out to form the surface layer to obtain a roller for an electrophotography. Here, the corona discharge treatment was carried out under the same conditions as those in Example 1 except that any bias was not applied to the conductive mandrel after the silica particles were so attached to the roller surface as to be in the amount of 0.020 mg/cm$^2$ in the same way as that in Example 1. The R2 of the roller after the corona discharge treatment was $5.0\times10^{5}\Omega$. Thus, it was seen to have been able to make the resin layer low in electric resistance.

Next, using as a developing roller the roller thus obtained, the evaluation by using the electrophotographic image forming apparatus was made in the same way as that in Example 1. Where solid black images are continuously reproduced using as a developing roller a roller for an electrophotography which has become high in electric resistance, the roller for the electrophotography becomes gradually high in its surface potential, so that the image density may inevitably vary. Accordingly, the value of change in image density can be used as an index of making the roller for the electrophotography low in electric resistance. The evaluation on change in image density was made according to the same criteria as those in Example 1.

If the phenomenon of short-circuit leakage occurs because of the discharge during the treatment for making low in electric resistance, image defects tend to occur which are caused by the leakage phenomenon in which the developing roller bias varies when images are formed. Especially where a blade bias is applied to the developing agent regulating blade so as to provide a potential difference from development bias, leakage current may flow to make the development bias vary to tend to cause horizontal line-like image defects. Accordingly, the extent of such horizontal lines can be used as an index of any difficulties of leakage caused by making the roller for the electrophotography low in electric resistance. The evaluation on leakage was made according to the same criteria as those in Example 1.

Comparative Example 5

Like Example 12, a roller was produced which had a columnar conductive mandrel and provided on the periphery thereof, as cover layers, an elastic layer and a resin layer which were each a single layer. The R1 of the roller produced was $3.0\times10^{7}\Omega$. Next, the roller was evaluated by using the electrophotographic image forming apparatus in the same way as that in Example 12 except that the attaching of silica particles and the corona discharge treatment were not carried out. The R2 at the time of evaluation was $3.0\times10^{7}\Omega$.

Comparative Example 6

Like Example 12, a roller was produced which had a columnar conductive mandrel and provided on the periphery thereof, as cover layers, an elastic layer and a resin layer which were each a single layer. The R1 of the roller produced was $3.0\times10^{7}\Omega$. Next, the roller was evaluated by using the electrophotographic image forming apparatus in the same way as that in Example 12 except that the corona discharge treatment was carried out without attaching the silica particles. The R2 after the corona discharge treatment was $2.0\times10^{4}\Omega$.

Example 13

Like Example 12, a roller was produced which had a columnar conductive mandrel and provided on the periphery thereof, as cover layers, an elastic layer and a resin layer which were each a single layer. The R1 of the roller produced was $3.0\times10^{7}\Omega$. Next, the roller was evaluated in the same way as that in Example 12 except that the silica particles were attached in an amount changed to 0.003 mg/cm$^2$ and then the corona discharge treatment was carried out to form the surface layer. The R2 of the roller after the corona discharge treatment was $7.0\times10^{4}\Omega$.

Example 14

Like Example 12, a roller was produced which had a columnar conductive mandrel and provided on the periphery thereof, as cover layers, an elastic layer and a resin layer which were each a single layer. The R1 of the roller produced was $3.0\times10^{7}\Omega$. Next, the roller was evaluated in the same way as that in Example 12 except that the silica particles were attached in an amount changed to 0.005 mg/cm$^2$ and then the corona discharge treatment was carried out to form the surface layer. The R2 of the roller after the corona discharge treatment was $3.0\times10^{5}\Omega$.

Example 15

Like Example 12, a roller was produced which had a columnar conductive mandrel and provided on the periphery thereof, as cover layers, an elastic layer and a resin layer which were each a single layer. The R1 of the roller produced was $3.0\times10^{7}\Omega$. Next, the roller was evaluated in the same way as that in Example 12 except that the silica particles were attached in an amount changed to 0.100 mg/cm$^2$ and then the corona discharge treatment was carried out to form the surface layer. The R2 of the roller after the corona discharge treatment was $6.0\times10^{5}\Omega$.

Example 16

Like Example 12, a roller was produced which had a columnar conductive mandrel and provided on the periphery thereof, as cover layers, an elastic layer and a resin layer which were each a single layer. The R1 of the roller produced was $3.0\times10^{7}\Omega$. Next, the roller was evaluated in the same way as that in Example 12 except that the silica particles were attached in an amount changed to 0.200 mg/cm$^2$ and then the corona discharge treatment was carried out to form the surface layer. The R2 of the roller after the corona discharge treatment was $1.0\times10^{6}\Omega$. The results of evaluation in Examples 1 to 16 and Comparative Examples 1 to 6 are shown in Table 6.

TABLE 6

| | Roller | Use | Amount of silica particles attached ($mg/cm^2$) | Corona discharge treatment | Bias applied (V) | R2/R1 | Change in image density | Leakage |
|---|---|---|---|---|---|---|---|---|
| Ex. 1 | Developing | Regenerate | 0.020 | Yes | +100 | 0.0250 | A | A |
| Cp. 1 | Developing | Regenerate | 0.000 | No | — | 1.0000 | D | A |
| Cp. 2 | Developing | Regenerate | 0.000 | Yes | No | 0.0010 | B | D |
| Ex. 2 | Developing | Regenerate | 0.003 | Yes | No | 0.0040 | A | B |
| Ex. 3 | Developing | Regenerate | 0.005 | Yes | No | 0.0050 | A | A |
| Ex. 4 | Developing | Regenerate | 0.020 | Yes | No | 0.0150 | A | A |
| Ex. 5 | Developing | Regenerate | 0.100 | Yes | No | 0.0400 | A | A |
| Ex. 6 | Developing | Regenerate | 0.150 | Yes | No | 0.0500 | B | A |
| Ex. 7 | Developing | Regenerate | 0.003 | Yes | +10 | 0.0200 | A | A |
| Ex. 8 | Developing | Regenerate | 0.003 | Yes | +100 | 0.0250 | A | A |
| Ex. 9 | Developing | Regenerate | 0.003 | Yes | +300 | 0.0250 | A | A |
| Ex. 10 | Developing | Regenerate | 0.003 | Yes | −100 | 0.0040 | A | B |
| Ex. 11 | Charging | Regenerate | 0.020 | Yes | +100 | 0.0400 | A | A |
| Cp. 3 | Charging | Regenerate | 0.000 | No | — | 1.0000 | C | A |
| Cp. 4 | Charging | Regenerate | 0.000 | Yes | +100 | 0.0008 | B | C |
| Ex. 12 | Developing | Produce | 0.020 | Yes | No | 0.0167 | A | A |
| Cp. 5 | Developing | Produce | 0.000 | No | — | 1.0000 | C | A |
| Cp. 6 | Developing | Produce | 0.000 | Yes | No | 0.0007 | B | D |
| Ex. 13 | Developing | Produce | 0.003 | Yes | No | 0.0023 | A | B |
| Ex. 14 | Developing | Produce | 0.005 | Yes | No | 0.0100 | A | A |
| Ex. 15 | Developing | Produce | 0.100 | Yes | No | 0.0200 | A | A |
| Ex. 16 | Developing | Produce | 0.200 | Yes | No | 0.0333 | B | A |

Ex.: Example; Cp.: Comparative Example

It has been found in Examples 1 to 11 to be the following. Attaching the silica particles to the surface layer of the roller for the electrophotography which has become high in electric resistance as a result of use and then subjecting to corona discharge treatment the surface layer to which the silica particles stand attached makes the surface layer low in electric resistance to enable the regenerated roller for the electrophotography to be obtained that can be reused. It has been found in Examples 12 to 16 to be the following. Attaching the silica particles to the surface of the resin layer and then subjecting to corona discharge treatment the surface of the resin layer to which the silica particles stand attached, to make the resin layer low in electric resistance to form the surface layer enables the roller for the electrophotography to be obtained that can enjoy formation of good images. It has been found in Examples 1 to 16 that subjecting to corona discharge treatment the surface layer to the surface of which the silica particles have been attached can make the conductive roller low in electric resistance. It has further been found in Table 6 and about Example 1, Examples 3-5, Examples 11-12 and Examples 14-15 that attaching the silica particles in an amount of from 0.005 $mg/cm^2$ to 0.100 $mg/cm^2$ can make the roller low in electric resistance effectively and without any difficulties. It has still further been found in Table 6 and about Examples 7-9 that carrying out the corona discharge treatment under application of a positive bias to the conductive mandrel can make the roller low in electric resistance effectively and without any difficulties.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 2009-288940, filed on Dec. 21, 2009, which is herein incorporated by reference as part of this application.

What is claimed is:

1. A process for decreasing an electric resistance of a conductive roller for electrophotography:

attaching silica particles on a surface of a roller for electrophotography, the roller including a conductive mandrel and a surface layer comprising a resin and carbon black dispersed therein;

subjecting corona discharge treatment to the surface of the roller on which the silica particles are attached so that the silica particles are negatively charged; and making the silica particles which have been negatively charged present in a higher density at a part where a corona electric current stands concentrated.

2. The process according to claim 1, wherein said step of subjecting corona discharge treatment comprises a step of applying a positive bias to the mandrel.

3. A process for producing a roller for an electrophotography, the roller including a conductive mandrel and a conductive surface layer comprising a resin and carbon black dispersed in the resin, said process comprising the steps of:

(1) forming a resin layer comprising the resin and carbon black dispersed therein on a circumference of the mandrel;

(2) attaching silica particles on a surface of the resin layer;

(3) subjecting corona discharge treatment to the surface of the resin layer on which the silica particles are attached so that the silica particles are negatively charged; and (4) making the silica particles which have been negatively charged present in a higher density at a part where corona electric current stands concentrated.

4. The process according to claim 3, wherein said step (2) comprises a step of attaching the silica particles on the surface layer in an amount of 0.005 $mg/cm^2$ to 0.100 $mg/cm^2$.

5. The process according to claim 3, wherein the silica particles have an average primary particle diameter of 70 nm or more to 300 nm or less.

6. A process for manufacturing a regenerated roller for electrophotography comprising the steps of:

providing a roller for electrophotography which has been used out, the roller including conductive mandrel and a surface layer comprising a resin and carbon black dispersed therein;

attaching silica particles on the surface provided with a conductive mandrel and a surface layer comprising a resin and carbon black layer;

subjecting corona discharge treatment to the surface layer on which the silica particles are attached so that the silica particles are negatively charged; and making the silica particles which have been negatively charged present in a higher density at a part where a corona electric current stands concentrated.

* * * * *